US009631860B2

(12) United States Patent
Gossens et al.

(10) Patent No.: US 9,631,860 B2
(45) Date of Patent: Apr. 25, 2017

(54) CHEST FREEZER

(71) Applicant: Electrolux Home Products, Inc., Charlotte, NC (US)

(72) Inventors: Caleb Gossens, Kalamazoo, MI (US); Benjamin Shrader, Charlotte, NC (US); Glenn L. Johnson, Cold Spring, MN (US); Chris Allen Baker, Anderson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 0 days.

(21) Appl. No.: 14/471,742

(22) Filed: Aug. 28, 2014

(65) Prior Publication Data

US 2016/0061513 A1 Mar. 3, 2016

(51) Int. Cl.

| | |
|---|---|
| ***A47B 96/04*** | (2006.01) |
| ***F25D 25/02*** | (2006.01) |
| ***F25D 23/02*** | (2006.01) |
| ***F25D 25/00*** | (2006.01) |
| ***A47F 3/04*** | (2006.01) |
| ***F25D 11/04*** | (2006.01) |

(52) U.S. Cl.

CPC ..... *F25D 25/022* (2013.01); *A47F 3/0426* (2013.01); *F25D 11/04* (2013.01); *F25D 23/026* (2013.01); *F25D 25/005* (2013.01); *F25D 2323/023* (2013.01); *F25D 2400/10* (2013.01)

(58) Field of Classification Search

CPC ..... F25D 3/06; F25D 25/022; F25D 2400/10
USPC ..... 62/457.1, 530; 312/405
See application file for complete search history.

(56) References Cited

U.S. PATENT DOCUMENTS

| | | | | | |
|---|---|---|---|---|---|
| 882,824 | A | * | 3/1908 | Hall | 62/457.7 |
| 1,385,274 | A | | 7/1921 | Rhodes | |
| 2,080,885 | A | * | 5/1937 | Cocks | 62/379 |
| 2,155,284 | A | * | 4/1939 | Steenstrup | 62/457.1 |
| 2,284,905 | A | | 6/1942 | Jackson | |
| 2,529,380 | A | * | 11/1950 | Fletcher | 220/592.08 |
| 2,615,592 | A | * | 10/1952 | Swedman | 220/529 |
| 3,287,073 | A | * | 11/1966 | Holtkamp | 312/36 |
| 3,325,236 | A | * | 6/1967 | Lustig | 312/293.2 |
| 3,406,532 | A | * | 10/1968 | Bridges et al. | 62/457.2 |
| 3,887,102 | A | * | 6/1975 | Earley | 220/8 |
| 3,915,328 | A | * | 10/1975 | Hawes et al. | 220/592.06 |
| 4,118,451 | A | | 10/1978 | Schaus | |
| 4,462,646 | A | | 7/1984 | Fleck | |
| 4,496,072 | A | | 1/1985 | Fleck | |
| 4,515,421 | A | | 5/1985 | Steffes | |
| 4,551,988 | A | * | 11/1985 | Petrantoni | 62/457.1 |

(Continued)

FOREIGN PATENT DOCUMENTS

| | | | | |
|---|---|---|---|---|
| FR | 2444243 | * | 7/1980 | B65D 1/22 |
| FR | 2590659 | A3 * | 5/1987 | F25D 23/08 |

(Continued)

OTHER PUBLICATIONS

International Search Report and Written Opinion issued in Application No. PCT/US2015/046047 dated Nov. 3, 2015.

*Primary Examiner* — Leslie A Nicholson, III
*Assistant Examiner* — Kimberley S Wright
(74) *Attorney, Agent, or Firm* — Pearne & Gordon, LLP

(57) ABSTRACT

A chest freezer includes a plurality of insulated walls forming a compartment that includes an upwardly facing opening. A door is configured to selectively provide access to the compartment through the upwardly facing opening. A breaker strip forms at least a portion of an upper periphery of the compartment. A channel is formed in at least a portion of the breaker strip. The channel is configured to permit attachment of a storage container thereto. A cantilevered storage container for a chest freezer is also provided.

9 Claims, 13 Drawing Sheets

(56) References Cited

U.S. PATENT DOCUMENTS

| | | | | |
|---|---|---|---|---|
| 4,718,960 | A | 1/1988 | Pasqualini | |
| 4,870,735 | A | 10/1989 | Jahr, Jr. et al. | |
| 5,397,087 | A | 3/1995 | Teece | |
| 5,626,407 | A | 5/1997 | Westcott | |
| 5,688,034 | A | 11/1997 | Kojima | |
| 5,899,544 | A * | 5/1999 | James et al. | 312/198 |
| 6,034,355 | A * | 3/2000 | Naderi et al. | 219/387 |
| 6,053,594 | A * | 4/2000 | Wenning et al. | 312/400 |
| 6,615,607 | B1 * | 9/2003 | Lee | 62/440 |
| 6,634,691 | B2 * | 10/2003 | Henderson | 296/37.6 |
| 6,658,857 | B1 * | 12/2003 | George | 62/3.3 |
| 7,284,393 | B1 * | 10/2007 | Macmillan | 62/457.7 |
| 7,690,517 | B2 | 4/2010 | Purushothaman et al. | |
| 8,356,723 | B2 * | 1/2013 | Clement et al. | 220/263 |
| 8,875,934 | B2 * | 11/2014 | Deka | 220/592.25 |
| 2003/0136271 | A1 * | 7/2003 | Kim | 99/467 |
| 2005/0035120 | A1 * | 2/2005 | Hull et al. | 220/23.87 |
| 2009/0315439 | A1 | 12/2009 | Turner | |
| 2011/0041545 | A1 * | 2/2011 | Clement et al. | 62/457.1 |
| 2012/0211499 | A1 * | 8/2012 | Clement et al. | 220/592.2 |
| 2012/0248957 | A1 | 10/2012 | Eaves et al. | |
| 2013/0062356 | A1 * | 3/2013 | Deka | 220/592.25 |

FOREIGN PATENT DOCUMENTS

| | | | |
|---|---|---|---|
| JP | S61-124887 | U | 8/1986 |
| JP | S63-123984 | U | 8/1988 |
| WO | 2014/082973 | A1 | 6/2014 |

* cited by examiner

CHEST FREEZER

TECHNICAL FIELD

The disclosure relates generally to a chest freezer and, more particularly, to a chest freezing having a channel formed in a breaker strip of the chest freezer. The channel is configured to permit attachment of a storage container thereto.

BACKGROUND

Chest freezers are known to include a compartment for storing food and other items at a temperature below zero degrees Centigrade. Some chest freezers include storage containers that can be placed in the compartment to hold various food and other items.

SUMMARY

The following presents a simplified summary of the disclosure in order to provide a basic understanding of some example aspects described in the detailed description.

In a first aspect of the disclosure, a chest freezer includes a plurality of insulated walls, a door, a breaker strip, and a channel. The plurality of insulated walls form a compartment that includes an upwardly facing opening. The door is configured to selectively provide access to the compartment through the upwardly facing opening. The breaker strip forms at least a portion of an upper periphery of the compartment, and the channel is formed in at least a portion of the breaker strip. The channel is configured to permit attachment of a storage container thereto.

In one example, the chest freezer further includes a mullion extending across the upwardly facing opening between an opposing two of the plurality of insulated walls. The mullion defines a first region and a second region of the upwardly facing opening. The door is a split door and includes a first door adjacent to a second door. The first door is configured to selectively provide access to the compartment through the first region and the second door is configured to selectively provide access to the compartment through the second region. The mullion is configured to provide a seal between at least one of a portion of the first door when the first door is oriented to restrict access to the compartment and a portion of the second door when the second door is oriented to restrict access to the compartment. At least a portion of the channel is arranged at an elevation below the mullion and is configured to permit attachment of a storage container thereto such that the storage container can slide underneath the mullion along the channel.

In another example, the storage container can slide underneath the mullion along the channel when at least one of the first door and the second door is oriented to restrict access to the compartment.

In yet another example, the at least a portion of the channel arranged at an elevation below the mullion extends under the mullion from a first location located in the first region to a second location located in the second region.

In still another example, the opposing two of the plurality of insulated walls include a front wall that opposes a rear wall. The breaker strip forms at least a portion of an upper periphery of the front wall and at least a portion of an upper periphery of the rear wall. The channel further includes a front channel formed in at least a portion of the breaker strip that forms at least a portion of an upper periphery of the front wall and a rear channel formed in at least a portion of the breaker strip that forms at least a portion of an upper periphery of the rear wall. The front channel and the rear channel are configured to respectively permit attachment of a first end and a second end of a storage container thereto such that the storage container can slide underneath the mullion along the front channel and the rear channel.

In still another example, the plurality of insulated walls include a front wall, a rear wall, a first side wall, and a second side wall. The front wall opposes the rear wall, the first side wall opposes the second side wall, and the front wall is adjacent to the first side wall and the second side wall. The breaker strip forms at least a portion of an upper periphery of each of the front wall, the rear, wall, the first side wall, and the second side wall. The channel further includes a front channel formed in at least a portion of the breaker strip that forms at least a portion of an upper periphery of the front wall, a rear channel formed in at least a portion of the breaker strip that forms at least a portion of an upper periphery of the rear wall, a first side channel formed in at least a portion of the breaker strip that forms at least a portion of an upper periphery of the first side wall, and a second side channel formed in at least a portion of the breaker strip that forms at least a portion of an upper periphery of the second side wall. Each of the front channel, rear channel, first side channel, and second side channel is configured to permit attachment of a storage container thereto.

In still another example, the channel further includes a sloped portion. The sloped portion extends from a bottom portion of the channel toward an opening of the channel.

In still another example, the channel further includes a first channel and a second channel. The first channel intersects the second channel at a corner of the compartment. Each of the first channel and the second channel includes a bottom portion and adjacent side portions. The adjacent side portions extend from the bottom portion in a substantially upward direction to form an opening of the channel. The corner includes a sloped portion that extends from the bottom portion of at least one of the first channel and the second channel toward the opening of at least one of the first channel and the second channel. In one example, the sloped portion includes a first sloped surface that extends from the bottom portion of the first channel toward the opening of the first channel and a second sloped surface that extends from the bottom portion of the second channel toward the opening of the second channel. At least a portion of the first sloped surface and the second sloped surface intersect at the corner of the compartment.

In still another example, at least one of the plurality of insulated walls includes an inner liner and an outer shell between which is an insulation material. At least a portion of the breaker strip forming at least a portion of the upper periphery of the compartment extends between the inner liner and the outer shell. The channel is formed in the at least a portion of the breaker strip that extends between the inner liner and the outer shell. In one example, the channel includes a bottom portion and adjacent side portions. The adjacent side portions extend from the bottom portion in a substantially upward direction to form an opening of the channel.

The first aspect of the disclosure may be provided alone or in combination with one or any combination of the examples of the first aspect of the disclosure discussed above.

In a second aspect of the disclosure, a chest freezer and a cantilevered storage container for the chest freezer include a channel configured to permit attachment of the cantilevered storage container thereto.

In one example, the cantilevered storage container is configured to slide along the channel.

In another example, the chest freezer further includes a mullion. At least a portion of the channel is arranged at an elevation below the mullion and is configured to permit attachment of the cantilevered storage container thereto such that the cantilevered storage container can slide underneath the mullion along the channel.

In yet another example, the channel includes a bottom portion and adjacent side portions. The adjacent side portions extend from the bottom portion in a substantially upward direction to form an opening of the channel. The cantilevered storage container includes an attachment member configured to engage at least a portion of the opening of the channel to attach the cantilevered storage container to the channel.

In still another example, the cantilevered storage container includes a first end and a second end, where the first end opposes the second end. The first end of the cantilevered storage container includes the attachment member configured to engage at least a portion of the opening of the channel. Between the first end and the second end of the cantilevered storage container, only the first end is attached to the channel.

The second aspect of the disclosure may be provided alone or in combination with one or any combination of the examples of the second aspect of the disclosure discussed above.

In a third aspect of the disclosure, a storage container for a chest freezer includes a first end opposite a second end. At least one of the first end and the second end includes an attachment member having a protrusion. The protrusion is configured to engage an opening of a channel of a chest freezer. The storage container is configured such that the first end and the second end cannot attach to the chest freezer at the same time.

In one example, the protrusion includes a hook shape configured to engage the opening of the channel of the chest freezer. The storage container is configured to hang from the channel by the hook shape.

In another example, the storage container includes a support piece configured to provide leveling support for the storage container.

In yet another example, the storage container further includes an aperture. The support piece is removable and includes a protrusion configured to be inserted into the aperture to attach the support piece to the storage container.

The third aspect of the disclosure may be provided alone or in combination with one or any combination of the examples of the third aspect of the disclosure discussed above.

BRIEF DESCRIPTION OF THE DRAWINGS

These as well as other aspects of the disclosure are better understood when the following detailed description is read with reference to the accompanying drawings, in which.

DETAILED DESCRIPTION

Figure 1:
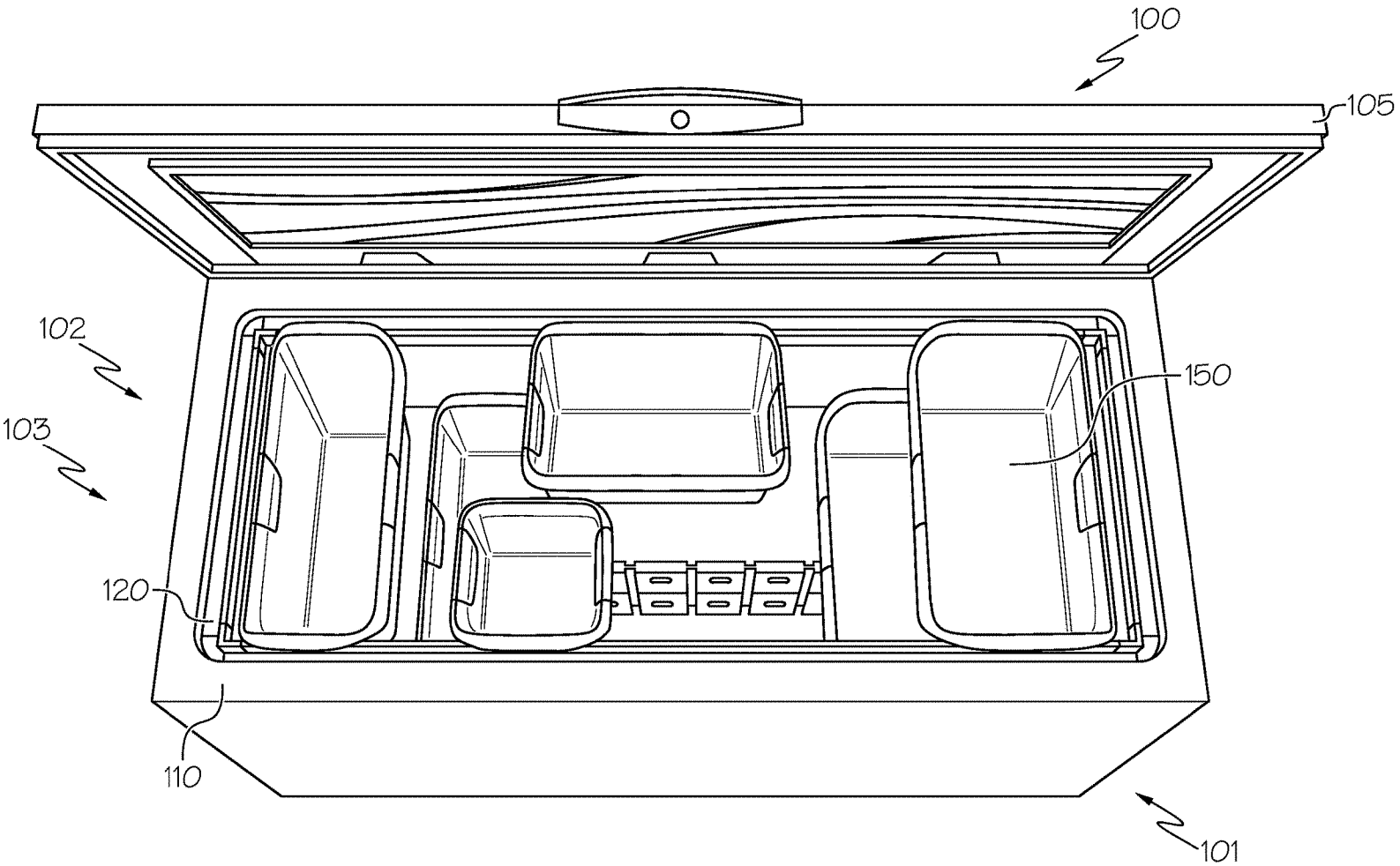
FIG. 1 illustrates a top perspective view of an example chest freezer according to examples of the disclosure.

Examples will now be described more fully hereinafter with reference to the accompanying drawings in which example embodiments are shown. Whenever possible, the same reference numerals are used throughout the drawings to refer to the same or like parts. However, aspects may be embodied in many different forms and should not be construed as limited to the embodiments set forth herein.

Referring to FIG. 1, a first example chest freezer 100 is provided with various example features that may be used either alone or in combination to provide storage options within the chest freezer 100. The chest freezer 100 can include a plurality of insulated walls 101 that form a compartment 102 having an upwardly facing opening 103. A door 105 can be configured to selectively provide access to the compartment 102 through the upwardly facing opening 103. A breaker strip 110 can form at least a portion of an upper periphery of the compartment 102. Additionally, a channel 120 can be formed in at least a portion of the breaker strip 110. As will be discussed more fully below, the channel 120 can be configured to permit attachment of a storage container 150 thereto. The storage container 150 can be provided in the chest freezer for storing various food and other items and can include features configured to permit attachment to the channel 120. Although not explicitly illustrated, it is to be understood that the chest freezer 100 can include an evaporator or other device configured to maintain the compartment 102 of the chest freezer 100 at a temperature below zero degrees Centigrade.

Figure 2:
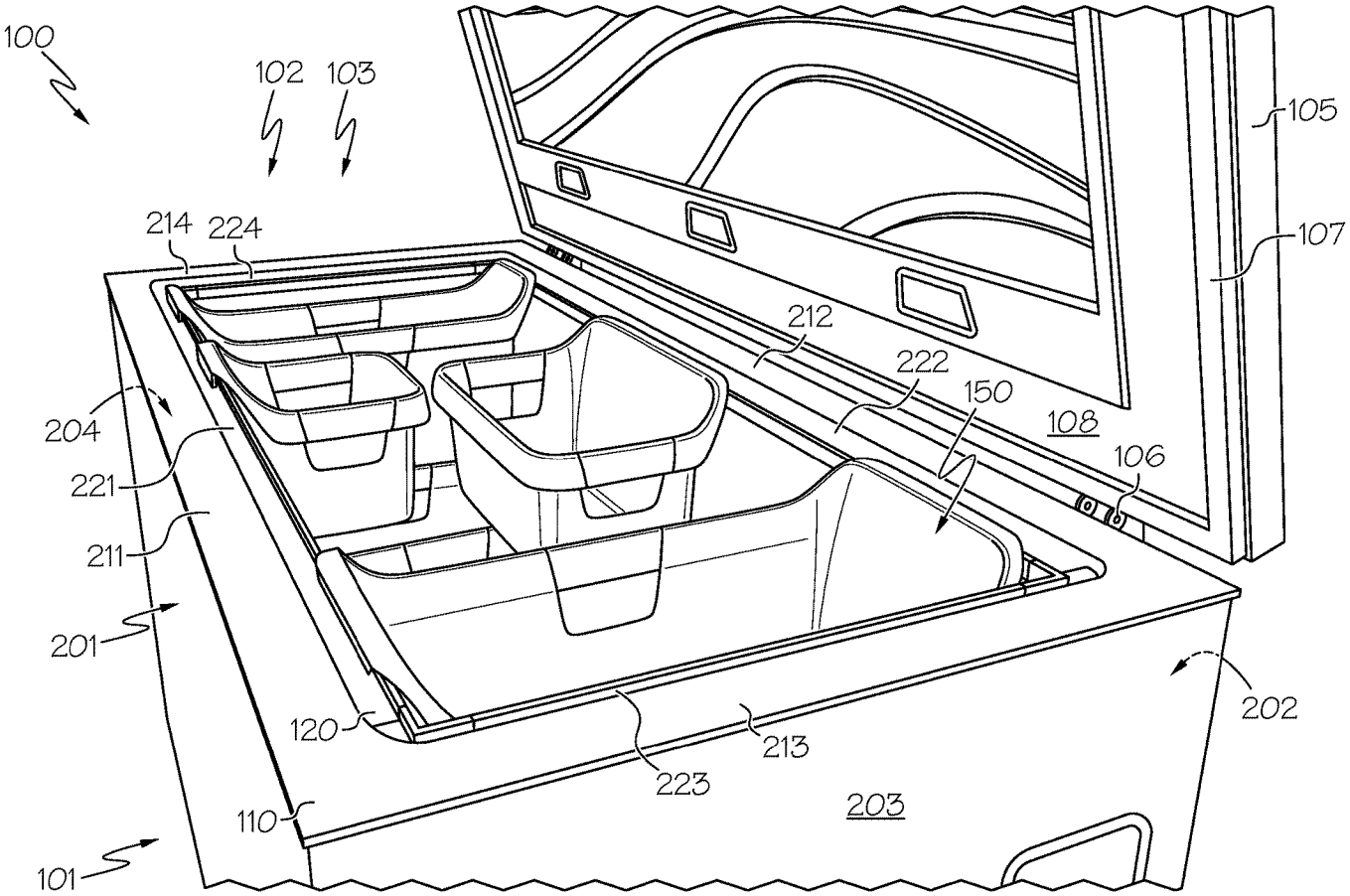
FIG. 2 illustrates a perspective view of the example chest freezer of FIG. 1.

Turning to FIG. 2, the door 105 can further comprise a hinge 106 or other member configured to provide rotational or pivotal support to the door 105 such that the door can be selectively rotated from a closed position restricting access to the compartment 102 to an open position permitting access to the compartment 102. The door 105 can also include a seal or gasket 107 around an edge of an inner face 108 of the door 105. The seal 107 can be configured to contact the breaker strip 110 when the door 105 is oriented in the closed position to help provide an airtight closure to the compartment 102.

As shown in FIGS. 1 and 2, the breaker strip 110 and the channel 120 can extend substantially continuously around the upper periphery of the compartment 102. The breaker strip 110 can be extruded, bent, or otherwise formed to a desired profile or shape, various examples of which will be discussed more fully below. In some examples, the breaker strip 110 and the channel 120 can be a seamless component; while in other examples, the breaker strip 110 and the channel 120 can comprise one or more sections that can be arranged around the upper periphery of the compartment and connected together such that the breaker strip 110 and the channel 120 extend substantially continuously around the upper periphery of the compartment 102.

In one example, as shown in FIG. 2, the plurality of walls 101 of the chest freezer 100 can include a front wall 201, a rear wall 202, a first side wall 203, and a second side wall 204. As shown, the front wall 201 can oppose the rear wall 202 and the first side wall 203 can oppose the second side wall 204. Further, the front wall 201 can be adjacent to the first side wall 203 and the second side wall 204. The breaker strip 110 can form at least a portion of an upper periphery of each of the front wall 201, the rear wall 202, the first side wall 203, and the second side wall 204. The channel 120 can include a front channel 221 formed in at least a portion of the breaker strip (e.g. front breaker strip 211) that forms at least a portion of an upper periphery of the front wall 201. The channel 120 can further include a rear channel 222 formed in at least a portion of the breaker strip (e.g. rear breaker strip 212) that forms at least a portion of an upper periphery of the rear wall 202. Still further, the channel 120 can include a first side channel 223 formed in at least a portion of the breaker strip (e.g. first side breaker strip 213) that forms at least a portion of an upper periphery of the first side wall 203, and a second side channel 224 formed in at least a portion of the breaker strip (e.g. second side breaker strip 214) that forms at least a portion of an upper periphery of the second side wall 204. Each of the front channel 221, rear channel 222, first side channel 223, and second side channel 224 can be configured to permit attachment of a storage container 150 thereto. As will be described more fully below, various sized storage containers can be provided with various features that can be included either alone or in combination to attach the storage container to the chest freezer. In other examples, the channel 120 may be formed in the breaker strip 110 forming the upper periphery of only one as well as more than one of any of the plurality of walls 101.

Figure 3:
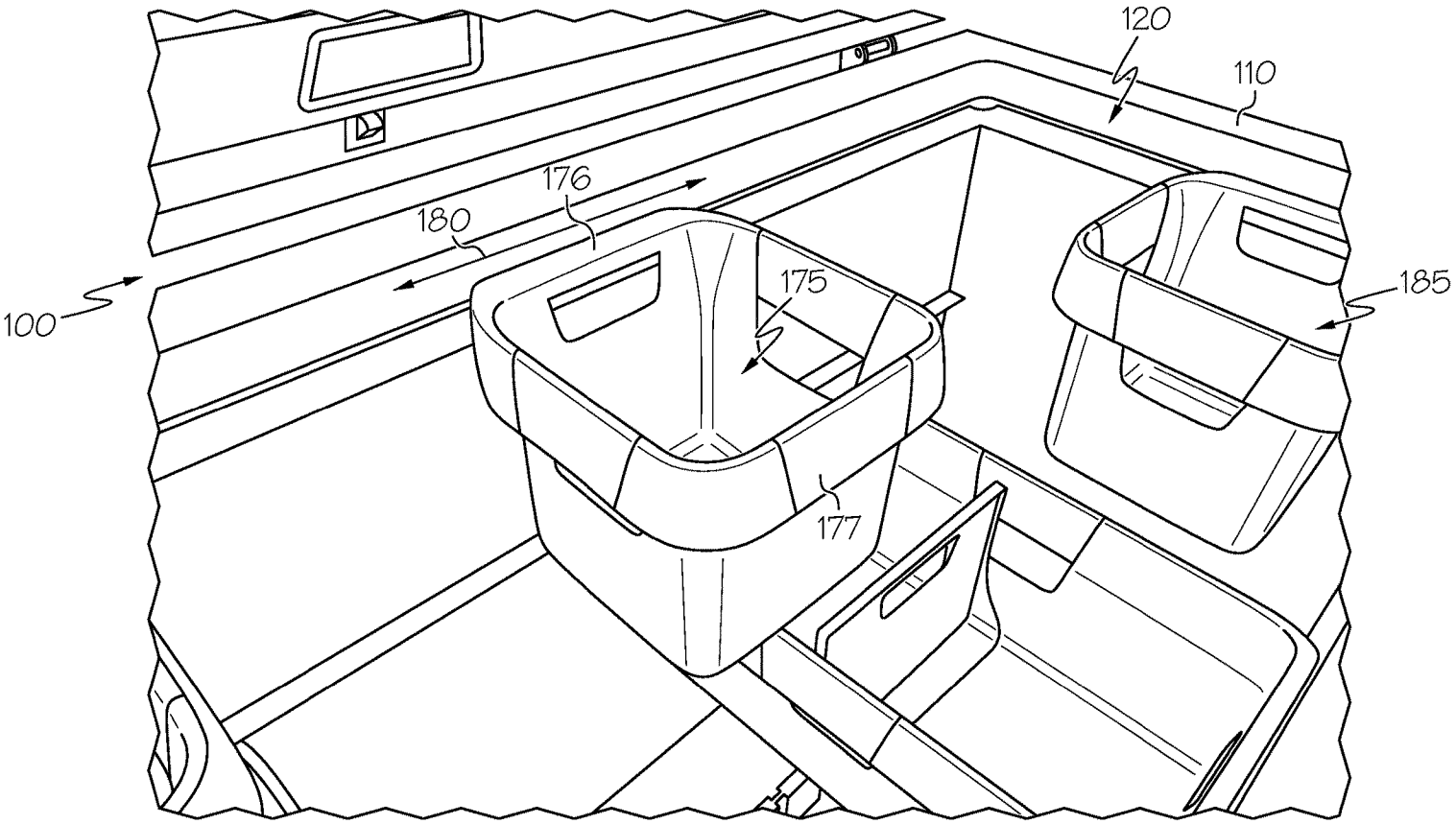
FIG. 3 illustrates a perspective view of a cantilevered storage container attached to the chest freezer of FIG. 1.
Figure 4:
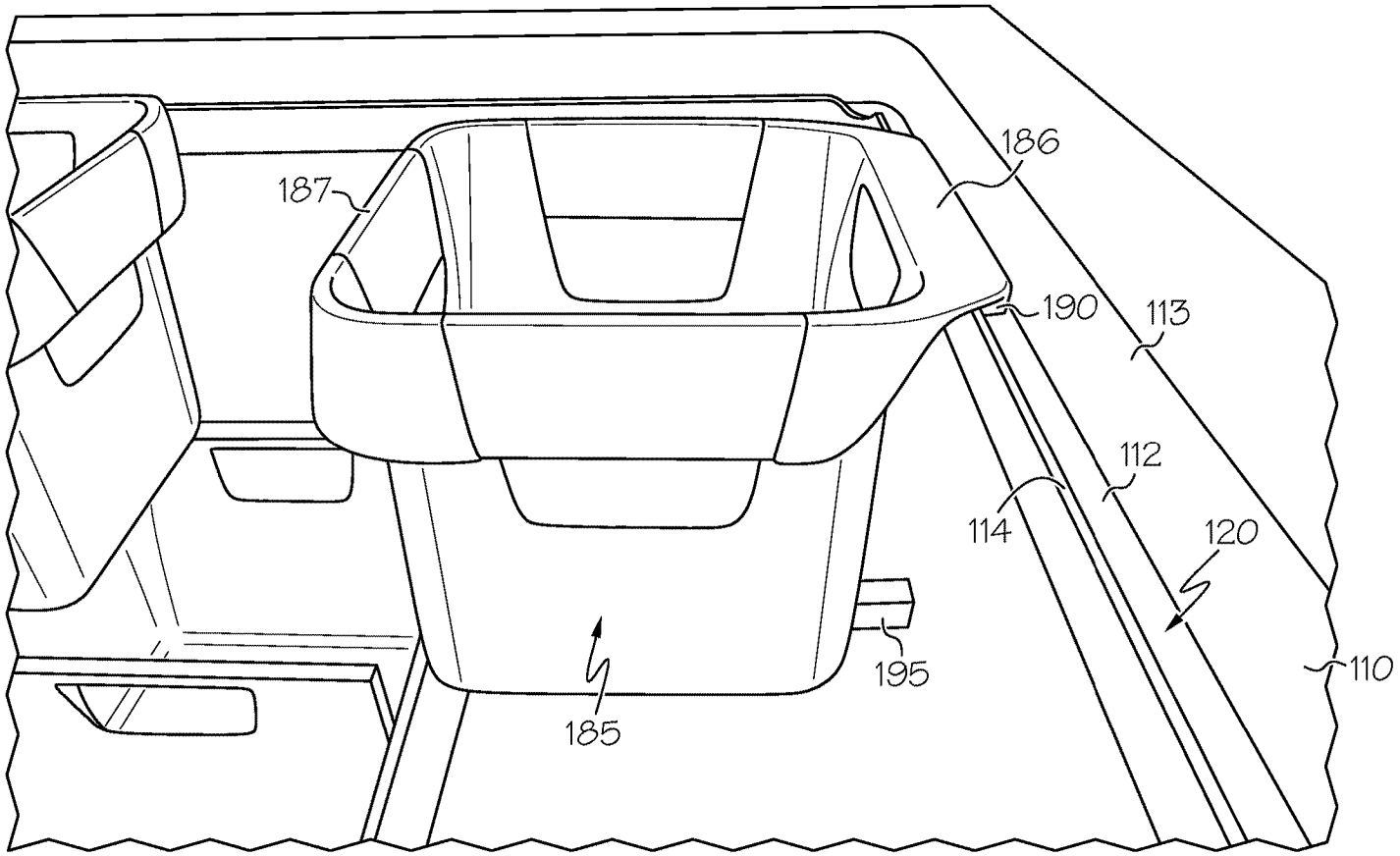
FIG. 4 illustrates a perspective view of another cantilevered storage container attached to the chest freezer of FIG. 1.

The first example chest freezer 100 is also shown in FIG. 3 and includes a cantilevered storage container 175. The chest freezer 100 includes the breaker strip 110 and the channel 120 formed in the breaker strip 110. The channel 120 is configured to permit attachment of the cantilevered storage container 175 thereto. As shown by arrow 180, the cantilevered storage container can be configured to slide along the channel 120 to provide a user flexibility with respect to options for storage and placement of storage containers in the chest freezer. The chest freezer 100 includes another example storage container 185, the side perspective view of which is shown in FIG. 4. As shown in FIG. 4, the channel 120 includes a bottom portion 112 and adjacent side portions 113, 114. The adjacent side portions 113, 114 extend from the bottom portion 112 in a substantially upward direction to form an opening of the channel 120. The cantilevered storage container 185 includes an attachment member 190 configured to engage at least a portion of the opening of the channel 120 to attach the cantilevered storage container 185 to the channel 120.

Turning back to FIG. 3, the cantilevered storage container 175 includes a first end 176 and a second end 177, where the first end 176 opposes the second end 177. Similarly, as shown in FIG. 4, the other cantilevered storage container 185 also includes a first end 186 and a second end 187, where the first end 186 opposes the second end 187. The first end 186 of the cantilevered storage container 185 comprises the attachment member 190 configured to engage at least a portion of the opening of the channel 120. Therefore, between the first end 186 and the second end 187 of the cantilevered storage container 185, only the first end 186 is attached to the channel 120. Likewise, between the first end 176 and the second end 177 of the cantilevered storage container 175, only the first end 176 is attached to the channel 120. For purposes of this disclosure, the term "cantilevered" is intended to refer to the scenario where a storage container is attached or supported on one end, while an opposing end is substantially free from attachment or support. A cantilevered storage container includes a storage container that attaches to the chest freezer on one end (e.g. one side of a basket) and remains free from attachment on an opposing end (e.g. an opposing side of the basket). The term "cantilevered" is not to be limited, however, to only a single attachment point or a single attachment member. For example, as shown in FIG. 4, the cantilevered storage container 185 can include a support piece 195 configured to provide leveling support to the cantilevered storage container 185. The cantilevered storage container 185, including the support piece 195 is to be understood as "cantilevered" with respect to its attachment inside the chest freezer 100. In contrast, the storage container 150, illustrated in FIG. 1, that includes opposing ends, both of which attach to the channel 120 of the chest freezer 100 at the same time is not "cantilevered" for purposes of this disclosure.

Figure 13A:
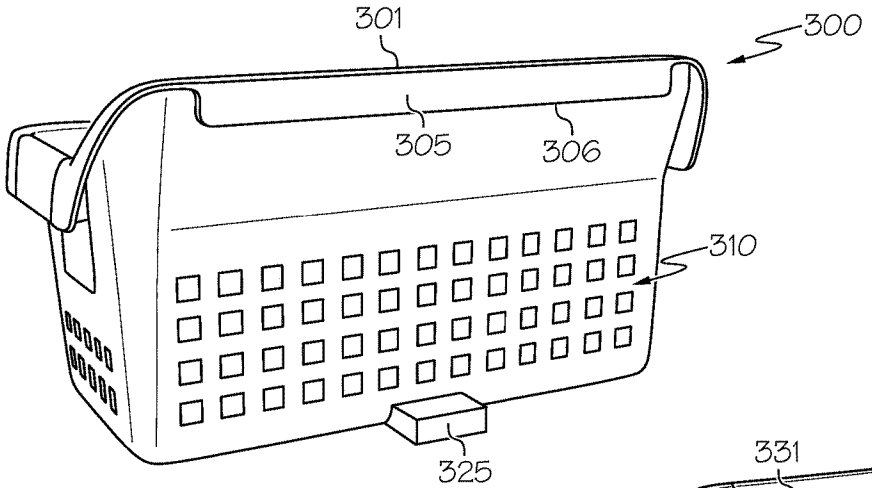
FIGS. 13A and 13B illustrate an example cantilevered storage container for a chest freezer.
Figure 13B:
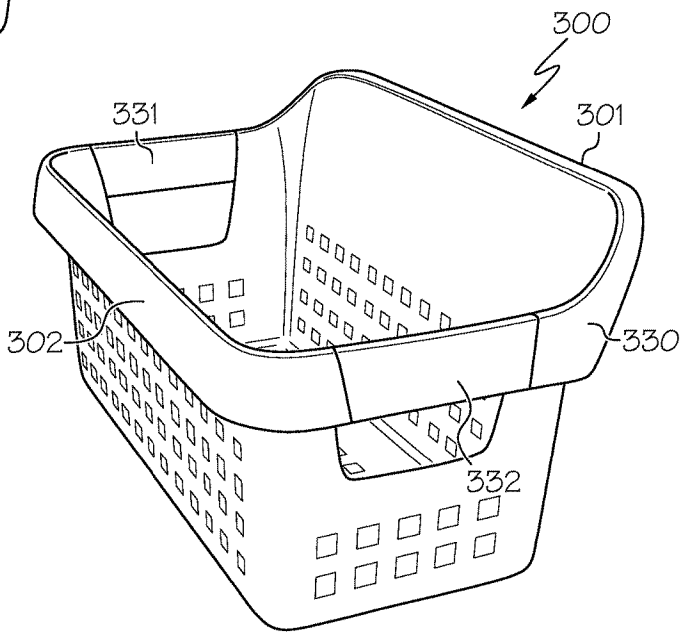
Figure 14B:
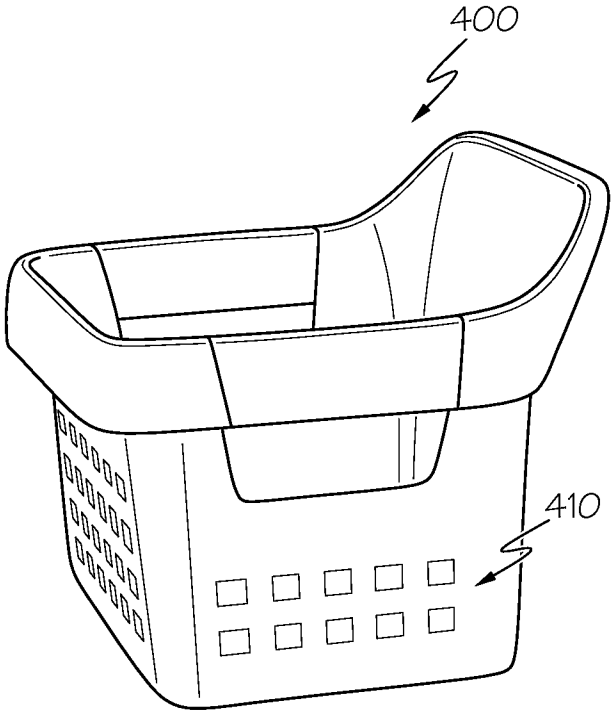
FIGS. 14A and 14B illustrate another example cantilevered storage container for a chest freezer.
Figure 14A:
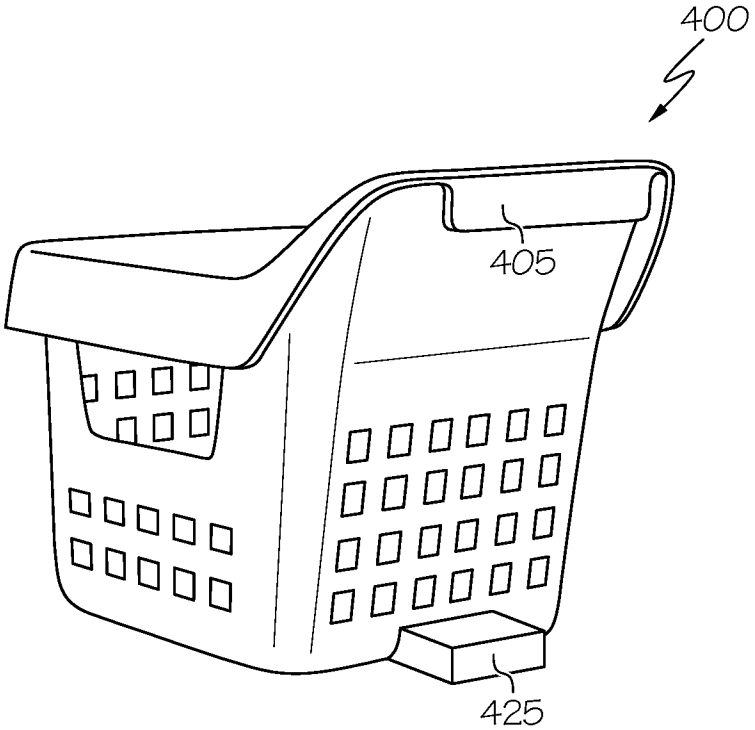

A first example cantilevered storage container 300 is provided in FIGS. 13A and 13B, while a second example cantilevered storage container 400 is provided in FIGS. 14A and 14B. The first example cantilevered storage container 300 includes a first end 301 opposite a second end 302. The first end 301 includes an attachment member 305 configured to attach to a chest freezer. Between the first end 301 and the second end 302 only the first end 301 is configured to attach to the chest freezer. For example, the first end 301 and the second end 302 cannot attach to the chest freezer at the same time. The attachment member 305 includes a protrusion 306 configured to engage an opening of a channel of the chest freezer. As shown, the upper periphery of the storage container 300 can include a formed edge 330 that extends around the upper periphery of the storage container 300. The formed edge 330 can include handles 331, 332 to enable a user to lift and/or slide the storage container 300. The attachment member 305, including the protrusion 306, can be integrally formed in the storage container 300 as a part of the formed edge 330. The storage container 300 can further include a plurality of holes 310 arranged in the storage container 300 for, among other purposes, permitting air circulation within and around the storage container 300.

Additionally, the storage container 300 can include a support piece 325 configured to provide leveling support for the storage container 300. For example, when the storage container 300 is attached to the channel of a chest freezer in a cantilevered fashion, it may have a tendency to hang askew (e.g. drift toward a side wall of the chest freezer) based on the center of gravity of the storage container with respect to is cantilevered attachment to the chest freezer. Accordingly, the support piece 325 can be provided to hold the storage container in a level position (e.g. away from the side wall of the chest freezer). The first example cantilevered storage container 300 is provided in a rectangular, basket shape; however, other shapes and dimensions can be provided in other examples. One such example is shown in FIGS. 14A-14B where the second example cantilevered storage container 400 is provided with a square or cube shape. The second example cantilevered storage container 400 can include the same or similar features as the first example cantilevered storage container 300, including an attachment member 405, a plurality of holes 410, and a support piece 425.

Figure 15A:
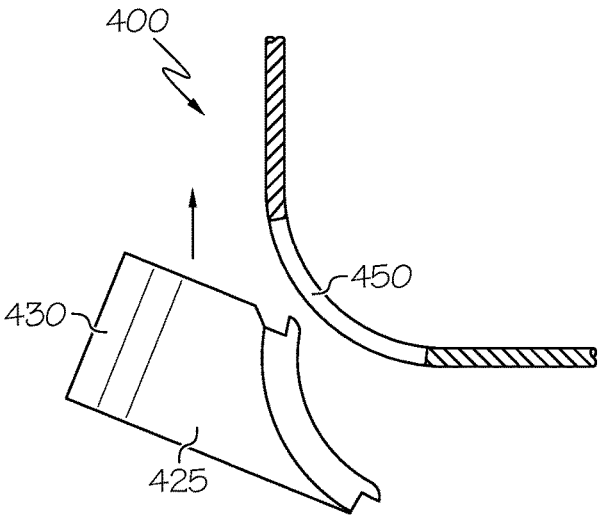
FIGS. 15A-15C illustrate an example of a removable support piece of a storage container for a chest freezer.
Figure 15B:
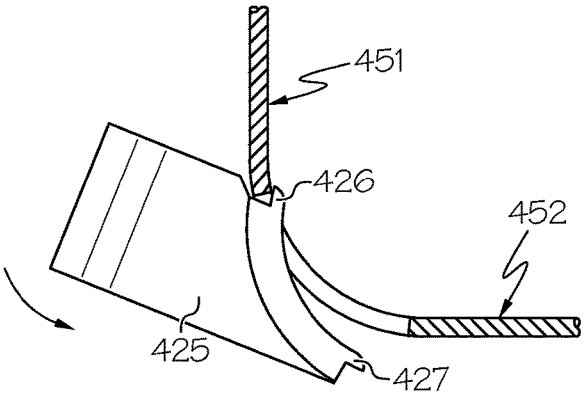
Figure 15C:
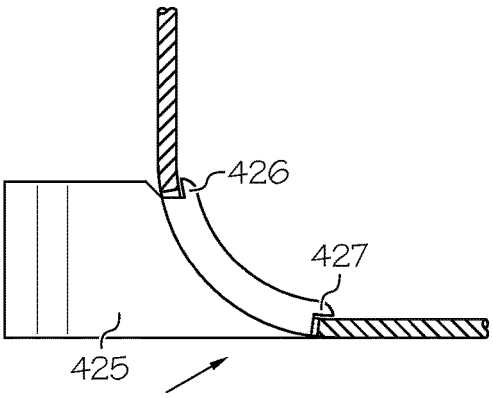

As shown in FIGS. 15A-15C, in some examples, the support piece 425 can be removable to enable stacking of storage containers (e.g. one in another) when the removable support piece 425 is removed. Referring to FIG. 15A, the storage container 400 can include an aperture 450. The aperture 450 can be formed at an edge or corner of the storage container 400 between a lateral wall 451 and a bottom wall 452 of the storage container 400. In other examples, the aperture 450 can be formed in any part of the storage container 400. Further, the removable support piece 425 can include a protrusion 426 configured to be inserted into the aperture 450 to attach the removable support piece 425 to the storage container 400. As shown in FIG. 15B, the protrusion 426 can abut an inner surface of the storage container (e.g. an inner surface of lateral wall 451). As further shown in FIG. 15C, the removable support piece 425 can be inserted into the aperture 450 such that another protrusion 427 attaches to the storage container 300. In one example, the removable support piece 425 can snap into the aperture 450. As shown, the other protrusion 427 can also abut an inner surface of the storage container (e.g. an inner surface of the bottom wall 452). In other examples, the removable support piece 425 can include an end 430 configured to contact an inner wall of the chest freezer. The end 430 can include a material configured to prevent scratching of the inner wall of the chest freezer, such as plastic, rubber, or other non-abrasive material.

Figure 5:
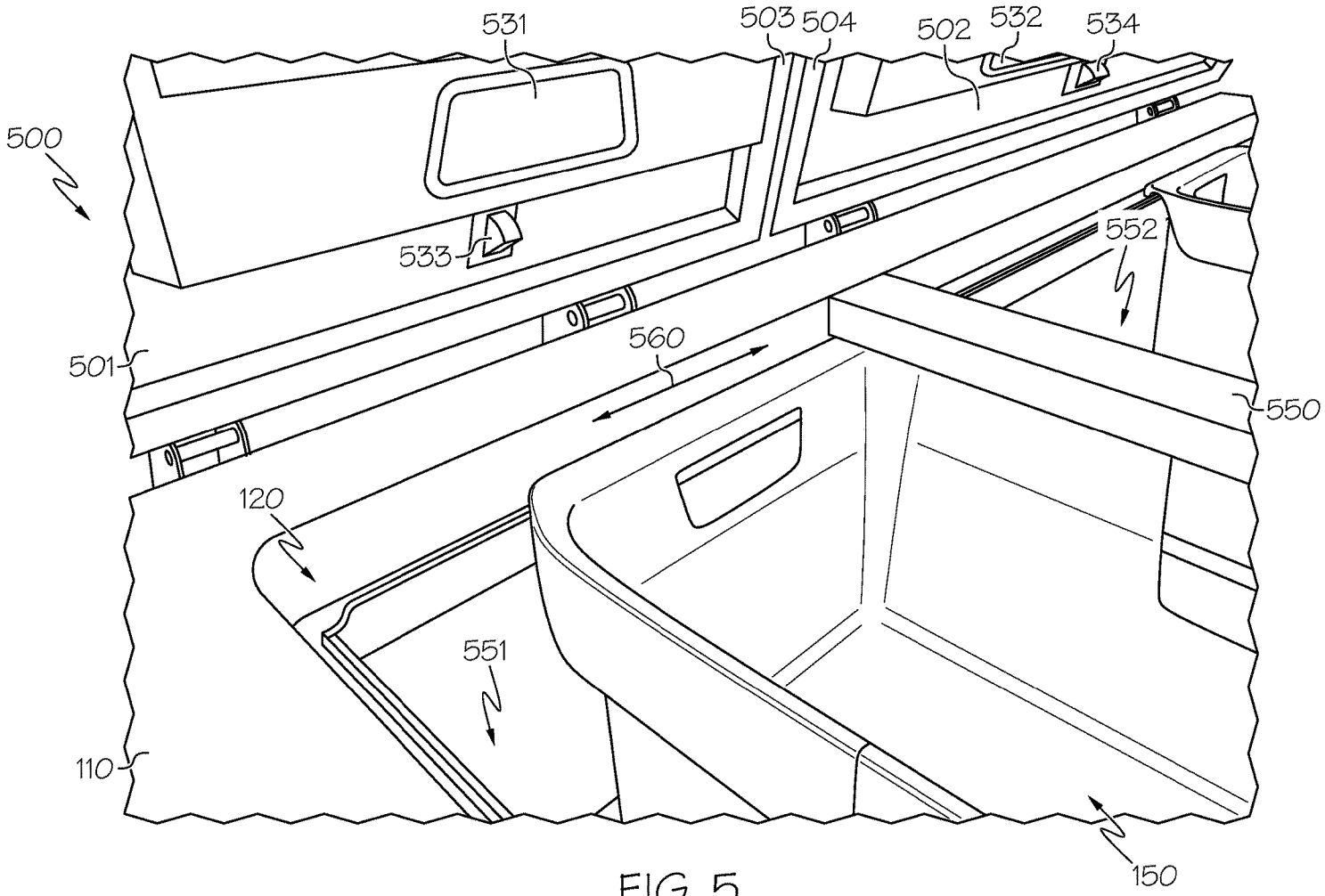
FIG. 5 illustrates a perspective view of another example chest freezer, including a mullion.

A second example chest freezer 500 in shown in FIG. 5. This chest freezer can include the same or similar features as the first example chest freezer 100 described above, including the breaker strip 110 and the channel 120 formed in the breaker strip 110. In addition, the second example chest freezer 500 includes a mullion 550 extending across the upwardly facing opening between an opposing two of the plurality of insulated walls. The mullion 550 defines a first region 551 and a second region 552 of the upwardly facing opening. Furthermore, the door of the chest freezer 500 is a split door having a first door 501 and a second door 502. The first door 501 is configured to selectively provide access to the compartment through the first region 551 and the second door 502 is configured to selectively provide access to the compartment through the second region 552. The first door 501 can include a first light 531 configured to illuminate the first region 551 when the first door 501 is oriented to permit access to the compartment. The first light 531 can be further configured to operate according to a sensor 533 configured to detect when the first door 501 is opened and illumination of the first region 551 is desirable. Likewise, the second door 502 can include a second light 532 configured to illuminate the second region 552 when the second door 502 is oriented to permit access to the compartment. The second light 532 can be further configured to operate according to a sensor 534 configured to detect when the second door 502 is opened and illumination of the second region 552 is desirable. The first light 531 and the second light 532 can be configured to operate independently of each other.

In some examples, the mullion 550 can be removable; while in other examples, the mullion 550 can be permanently fixed in the chest freezer. Further, the mullion 550 can be configured to provide a seal between a portion of the first door (e.g. first edge 503) when the first door 501 is oriented to restrict access to the compartment through the first region 551. Similarly, the mullion 550 can be configured to provide a seal between a portion of the second door (e.g. second edge 504) when the second door 502 is oriented to restrict access to the compartment through the second region 552. As noted, the chest freezer 500 can include the breaker strip 110 and the channel 120 formed in the breaker strip 110, with the understanding that any of the features of other example breaker strips and channels disclosed herein can also be included. As shown, at least a portion of the channel 120 can be arranged at an elevation below the mullion 550. Thus, the channel 120 can be configured to permit attachment of a storage container 150 to the channel such that the storage container 150 can slide underneath the mullion 550 along the channel 120 (as shown by arrow 560). In one example, the storage container 150 can slide underneath the mullion 550 along the channel 120 when at least one of the first door 501 and the second door 502 is oriented to restrict access to the compartment. To enable the storage container 150 to slide along the channel 120 underneath the mullion 550, the channel 120 can extend under the mullion 550 from a first location located in the first region 551 to a second location located in the second region 552.

Figure 6:
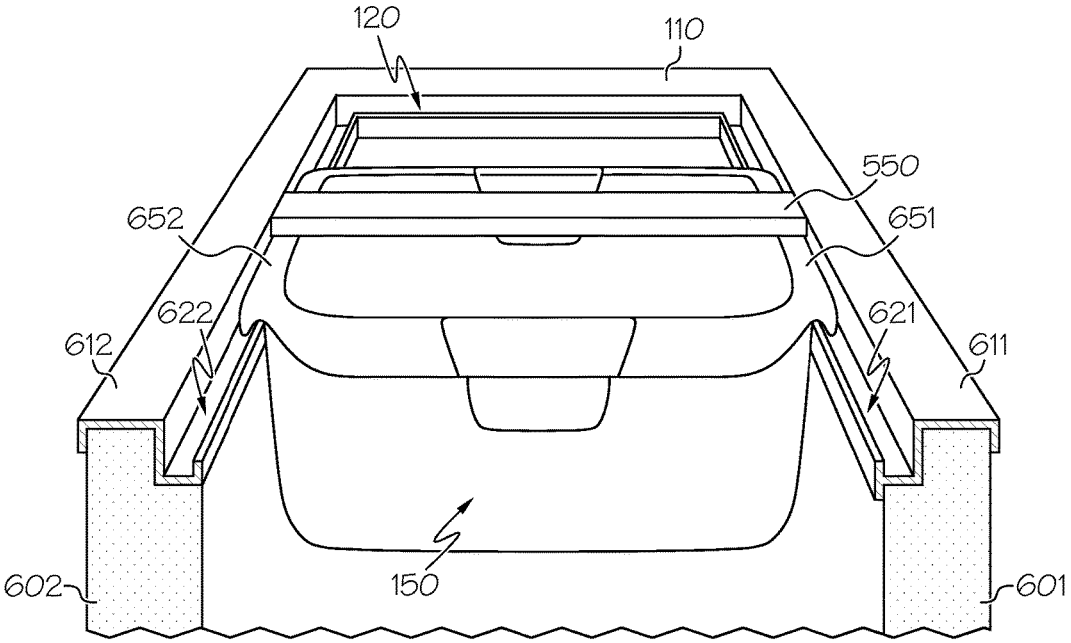
FIG. 6 illustrates an example storage container for a chest freezer including a channel formed in a breaker strip of the chest freezer.
Figure 7:
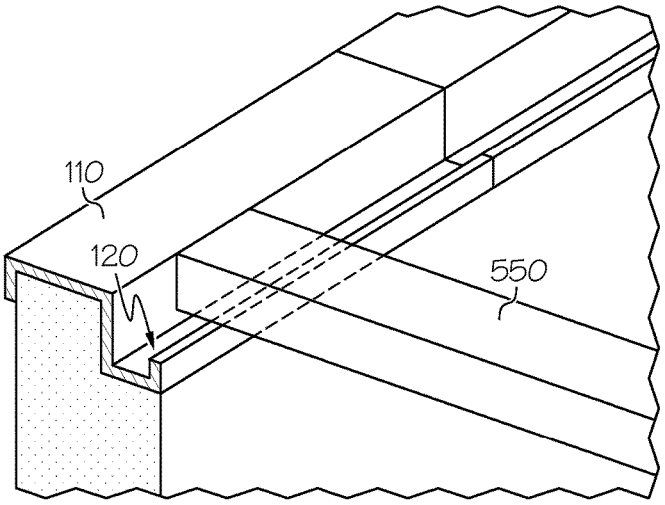
FIG. 7 illustrates the channel formed in the breaker strip of the chest freezer of FIG. 6 extending underneath a mullion.

Turning to FIG. 6, a cross-sectional view taken from a side of the second example chest freezer 500 is provided with the doors removed for clarity. As shown, the chest freezer 500 can include two insulated walls that oppose each other (e.g. front wall 601 and rear wall 602). The breaker strip 110 forms at least a portion of an upper periphery of the front wall 601 and at least a portion of an upper periphery of the rear wall 602 (e.g. front breaker strip 611 and rear breaker strip 612). The channel 120 can include a front channel 621 formed in at least a portion of the front breaker strip 611 and a rear channel 622 formed in at least a portion of the rear breaker strip 612. The front channel 621 and the rear channel 622 are configured to respectively permit attachment of a first end 651 and a second end 652 of a storage container 150 thereto such that the storage container 150 can slide underneath the mullion 550 along the front channel 621 and the rear channel 622. It is to be understood that the front breaker strip 611 and the front channel 621 can have a different shape than the rear breaker strip 612 and the rear channel 622, as illustrated. In other examples, one, more than one, or all of the breaker strips and channels of the chest freezer can include the same or different shape. As illustrated in FIG. 7, the channel 120 can be arranged below and extend underneath the mullion 550. It is to be understood that this disclosure contemplates any of the storage containers 150, including the cantilevered storage containers 175, 185, as well as those storage containers not explicitly described herein that can be configured to attach to the channel 120 below the mullion 550 and configured to slide along the channel 120 underneath the mullion 550.

Figure 8:
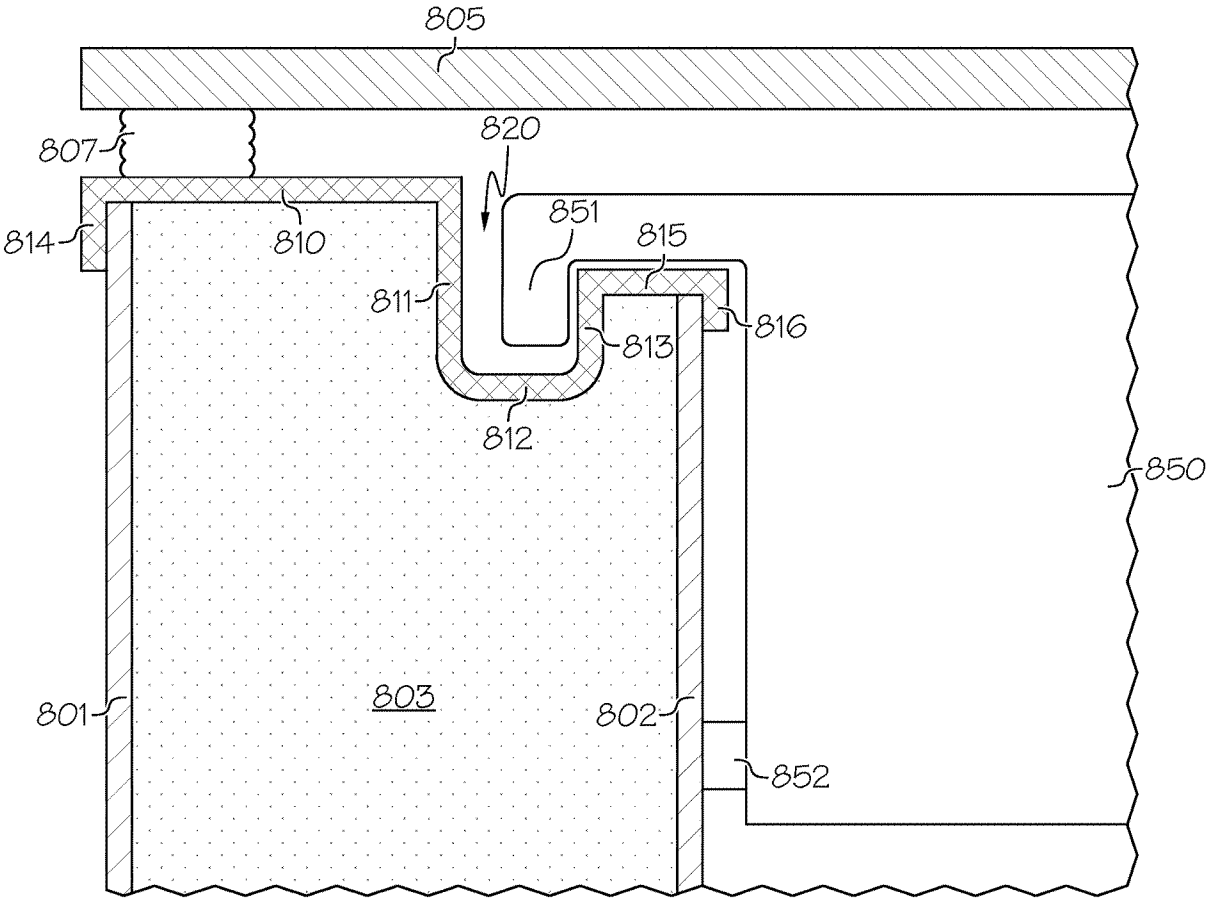
FIG. 8 illustrates a cross-sectional view of a channel formed in a breaker strip of a chest freezer.

Turning to FIG. 8, a cross-sectional view of an example breaker strip 810 and example channel 820 are provided with the understanding that the example breaker strip 810 and example channel 820 can be included in any chest freezer alone or in combination with any of the example features disclosed herein. As shown, an example door 805 (e.g. the door 105 or the split door with first door 501 and second door 502) and an example seal or gasket 807 can be provided to abut the breaker strip 810 forming a sealed enclosure and restricting access to the compartment. Additionally, the insulated wall can include an outer shell 801 and an inner liner 802. An insulation material 803 (e.g. foamed-in insulation) or other material can be provided between the inner liner 802 and the outer shell 801. The breaker strip 810 can form at least a portion of the upper periphery of the compartment and can extend between the inner liner 802 and the outer shell 801. For example, the breaker strip 800 can include an outer portion 814 that extends over and/or around the outer shell 801 to form an outside edge of the upper periphery of the compartment. Similarly, the breaker strip 810 can include an inner portion 816 that extends over and/or around the inner shell 802 to form an inner edge of the upper periphery of the compartment. The channel 820 can be formed in the portion of the breaker strip 810 that extends between the inner liner 802 and the outer shell 801.

As further shown, the channel 820 can include a bottom portion 812 and adjacent side portions 811 and 813. The adjacent side portions 811, 813 can extend from the bottom portion 812 in a substantially upward direction to form an opening of the channel 820. The channel can include a lip portion 815 that extends from the opening of the channel 820 towards the compartment of the chest freezer. The inner wall 802 can provide structural support to the lip portion 815 of the channel 820. A storage container 850 can be provided in the chest freezer to attach to the channel 820. The storage container 850 can include an attachment member 851 configured to attach to the opening of the channel 820. The attachment member 851 can include a hook-shaped protrusion that spans the lip portion 815 of the channel 820 and engages the opening of the channel 820. The storage container 850 can hang from the channel 820 by the hook-shaped protrusion. The storage container 850 can further include a support piece 852 configured to provide leveling support to the storage container 850.

Figure 9:
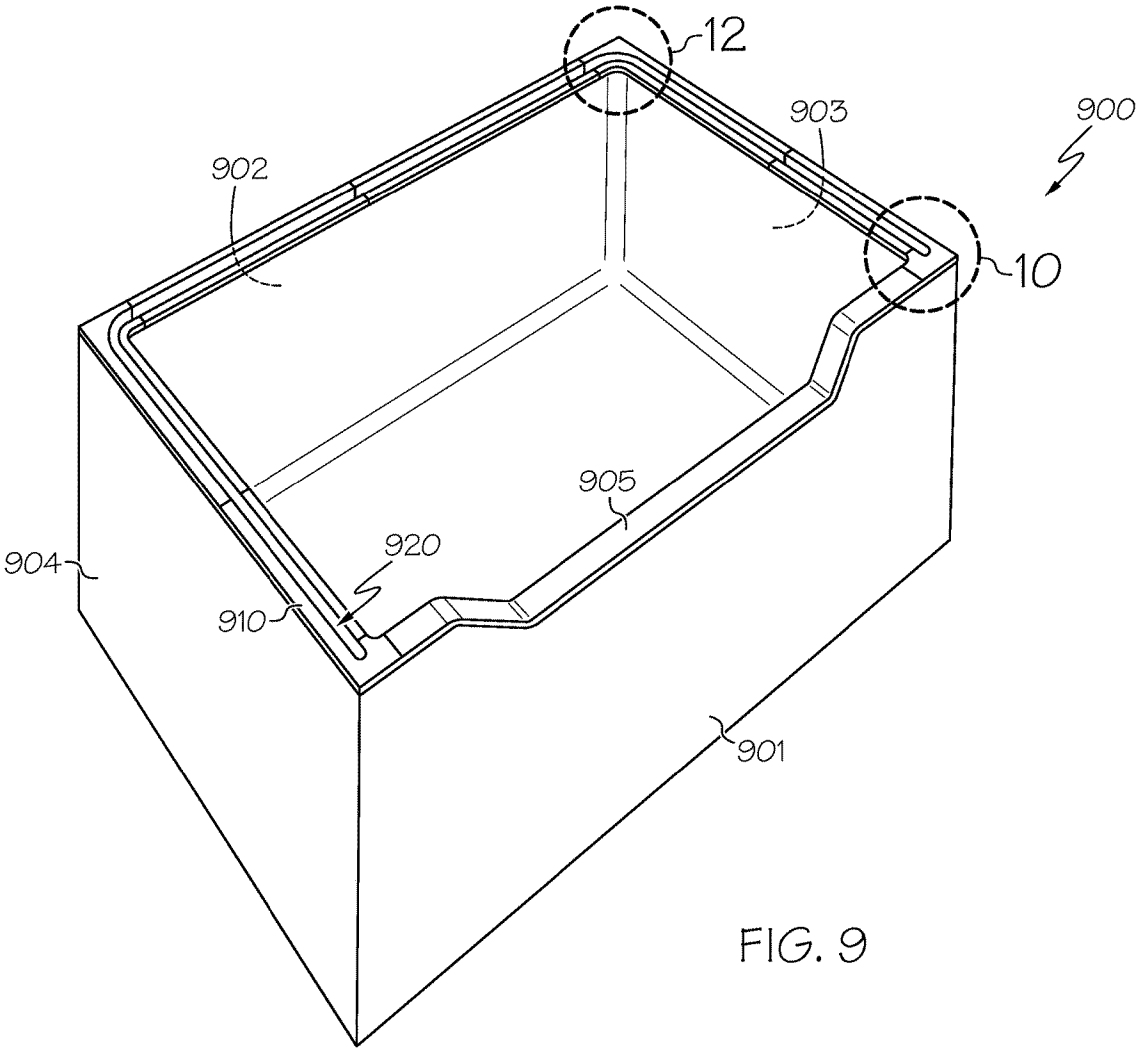
FIG. 9 illustrates a top perspective view of a chest freezer, including a channel formed in a breaker strip.
Figure 10:
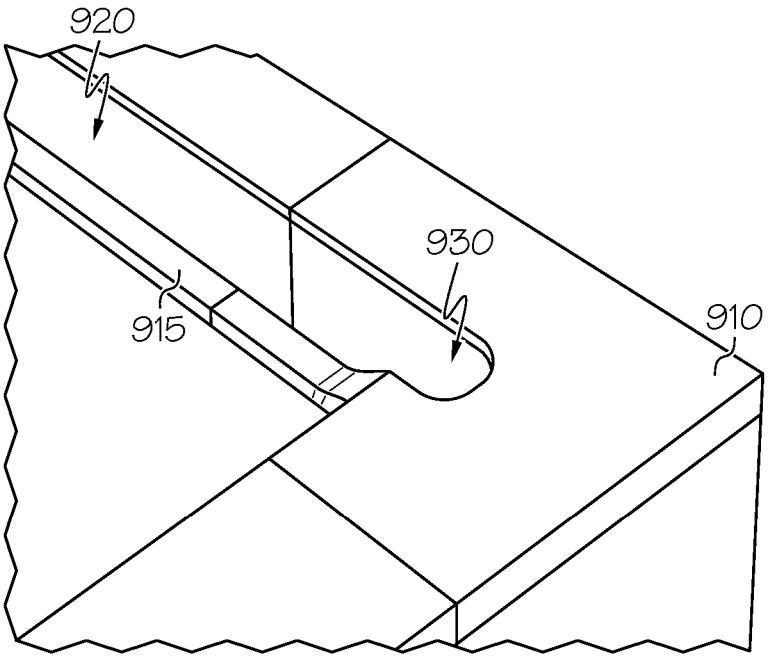
FIG. 10 illustrates an enlarged view of the channel formed in the breaker strip of the chest freezer of FIG. 9.
Figure 11:
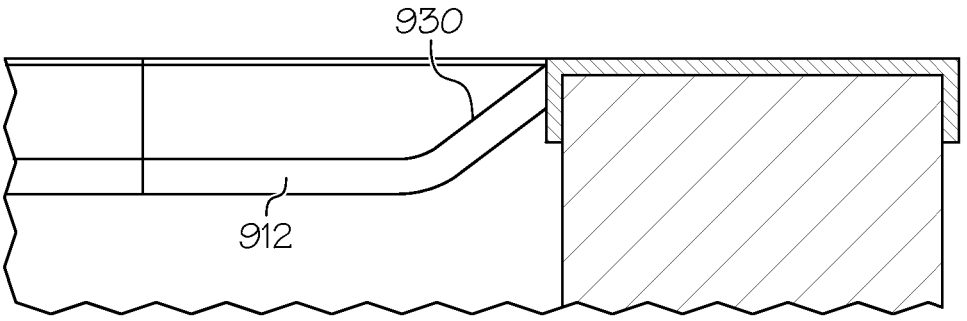
FIG. 11 illustrates a cross-sectional view of the channel formed in the breaker strip of the chest freezer of FIG. 9.

FIG. 9 shows another example chest freezer 900. The chest freezer 900 includes a breaker strip 910 and a channel 920 formed in the breaker strip 910. The breaker strip 910 forms an upper periphery of each of a front wall 901, a rear wall 902, and adjacent side walls 903, 904. The channel 920 is formed in the breaker strip 910 along the upper periphery of the rear wall 902 and the adjacent side walls 903, 904. The front wall 901 includes a recessed portion 905 along its upper periphery to enable a user to more easily reach into the compartment of the chest freezer 900. An enlarged view of the breaker strip 910 and channel 920 is shown in FIG. 10. The channel is configured to permit attachment of a storage container thereto and includes a lip portion 915 that can provide attachment support to the storage container. As shown in FIG. 11, a cross-sectional view of the breaker strip 910 and channel 920 shows a sloped portion 930 extending from a bottom portion of the channel 920 toward an opening of the channel 920. The sloped portion 930 can be configured to promote removal of debris (e.g. crumbs, dust, and dirt) that may accumulate in the channel 920. For example, the sloped portion 930 can enable a user to gather or push the debris along the channel 920 toward the sloped portion 930 and up the sloped portion 930 toward the opening of the channel 920 where the debris can be removed and disposed of accordingly.

Figure 12:
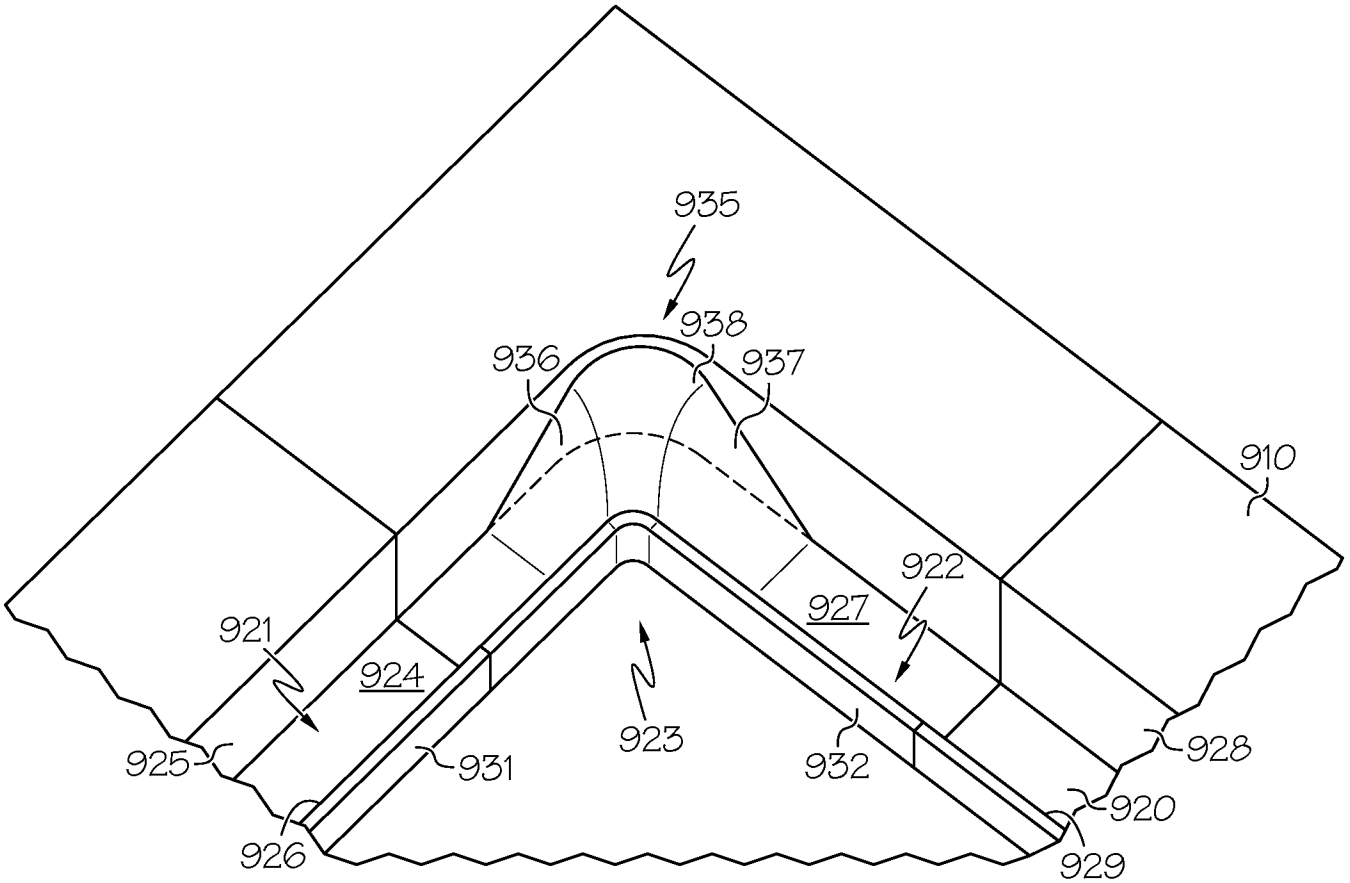
FIG. 12 illustrates a sloped portion in the channel formed in the breaker strip of the chest freezer of FIG. 9.

Another example of an embodiment configured to promote removal of debris within the channel 920 is shown in FIG. 12, where the channel 920 includes a first channel 921 and a second channel 922. As shown, the first channel 921 intersects the second channel 922 at a corner 923 of the compartment. Further, each of the first channel 921 and the second channel 922 includes a bottom portion 924, 927 and adjacent side portions 925, 926 and 928, 929. The adjacent side portions 925, 926 and 928, 929 extend from the bottom portions 924, 927 in a substantially upward direction to form an opening of the channel 920. The corner 923 comprises another sloped portion 935 that extends from the bottom portion 924, 927 of at least one of the first channel 921 and the second channel 922 toward the opening of at least one of the first channel 921 and the second channel 922. In one example, the other sloped portion 935 can include a first sloped surface 936 that extends from the bottom portion 924 of the first channel 921 toward the opening of the first channel 921 and a second sloped surface 937 that extends from the bottom portion 927 of the second channel 922 toward the opening of the second channel 922. In another example, at least a portion of the first sloped surface 936 and the second sloped surface 937 intersect at the corner 935 of the compartment. As shown, the first sloped surface 936 and the second sloped surface 937 can intersect and form a sloped region 938 that is further configured to promote the removal of debris from the channel 920. It is to be understood that other configurations, including those not explicitly illustrated, wherein the channel includes a sloped portion are contemplated by this disclosure.

It will be apparent to those skilled in the art that various modifications and variations can be made to the present disclosure without departing from the spirit and scope of the subject matter claimed.

What is claimed is:

1. A chest freezer and a storage container for the chest freezer, wherein the chest freezer comprises:

a plurality of insulated walls forming a compartment that comprises an upwardly facing opening;

a door configured to selectively provide access to the compartment through the upwardly facing opening;

a breaker strip forming at least a portion of an upper periphery of and fixed to the compartment so as to be immovable upon movement of the door; and a channel configured to permit attachment of the storage container thereto, and wherein at least one of the plurality of insulated walls comprises an inner liner and an outer shell between which comprises an insulation material, wherein at least a portion of the breaker strip forming at least a portion of the upper periphery of the compartment extends between the inner liner and the outer shell, and wherein the channel is formed in the at least a portion of the breaker strip that extends between the inner liner and the outer shell and comprises a bottom portion and adjacent side portions, wherein the adjacent side portions extend from the bottom portion in a substantially upward direction to form an opening of the channel, the bottom portion being located between the inner liner and the outer shell at the insulation material.

2. The chest freezer and storage container for the chest freezer of claim 1, wherein the storage container is configured to slide along the channel.

3. A chest freezer and a storage container for the chest freezer, wherein the chest freezer comprises:

a plurality of insulated walls forming a compartment that comprises an upwardly facing opening;

a door configured to selectively provide access to the compartment through the upwardly facing opening;

a breaker strip forming at least a portion of an upper periphery of the compartment a channel configured to permit attachment of the storage container thereto, and wherein at least one of the plurality of insulated walls comprises an inner liner and an outer shell between which comprises an insulation material, wherein at least a portion of the breaker strip forming at least a portion of the upper periphery of the compartment extends between the inner liner and the outer shell, and wherein the channel is formed in the at least a portion of the breaker strip that extends between the inner liner and the outer shell and comprises a bottom portion and adjacent side portions, wherein the adjacent side portions extend from the bottom portion in a substantially upward direction to form an opening of the channel, the bottom portion being located within the insulation material; and a mullion extending across the upwardly facing opening between an opposing two of the plurality of insulated walls and defining a first region and a second region of the upwardly facing opening, wherein at least a portion of the channel is arranged at an elevation below the mullion, and wherein the at least a portion of the channel is configured to permit attachment of the storage container thereto and extends under the mullion from a first location located in the first region to a second location located in the second region such that the storage container can slide underneath the mullion along the channel between the first location and the second location.

4. The chest freezer and storage container for the chest freezer of claim 1, wherein the channel comprises a bottom portion and adjacent side portions, and wherein the storage container comprises an attachment member configured to engage at least a portion of the opening of the channel to attach the storage container to the channel.

5. The chest freezer and storage container for the chest freezer of claim 4, wherein the storage container is a cantilevered storage container and comprises a first end and a second end, wherein the first end opposes the second end, wherein the first end of the cantilevered storage container comprises the attachment member configured to engage at least a portion of the opening of the channel, and wherein, between the first end and the second end of the cantilevered storage container, only the first end is attached to the channel.

6. The chest freezer and storage container for the chest freezer of claim 3, wherein the door is a split door comprising a first door adjacent to a second door, wherein the first door is configured to selectively provide access to the compartment through the first region and the second door is configured to selectively provide access to the compartment through the second region, and wherein the mullion is configured to provide a seal between at least one of a portion of the first door when the first door is oriented to restrict access to the compartment and a portion of the second door when the second door is oriented to restrict access to the compartment.

7. The chest freezer and storage container for the chest freezer of claim 6, wherein the storage container can slide underneath the mullion along the channel between the first location and the second location when at least one of the first door and the second door is oriented to restrict access to the compartment.

8. The chest freezer and cantilevered storage container for the chest freezer of claim 3, wherein the opposing two of the plurality of insulated walls comprises:

a front wall that opposes a rear wall, wherein the breaker strip forms at least a portion of an upper periphery of the front wall and at least a portion of an upper periphery of the rear wall, wherein the channel further comprises a front channel formed in at least a portion of the breaker strip that forms at least a portion of the upper periphery of the front wall and a rear channel formed in at least a portion of the breaker strip that forms at least a portion of the upper periphery of the rear wall, and wherein the front channel and the rear channel are configured to respectively permit attachment of a first end and a second end of the storage container thereto such that the storage container can slide underneath the mullion along the front channel and the rear channel between the first location and the second location.

9. The chest freezer and storage container for the chest freezer of claim 1, wherein the plurality of insulated walls comprises:

a front wall, a rear wall, a first side wall, and a second side wall; wherein the front wall opposes the rear wall, the first side wall opposes the second side wall, and the front wall is adjacent to the first side wall and the second side wall, wherein the breaker strip forms at least a portion of an upper periphery of each of the front wall, the rear, wall, the first side wall, and the second side wall, wherein the channel further comprises a front channel formed in at least a portion of the breaker strip that forms at least a portion of an upper periphery of the front wall, a rear channel formed in at least a portion of the breaker strip that forms at least a portion of an upper periphery of the rear wall, a first side channel formed in at least a portion of the breaker strip that forms at least a portion of an upper periphery of the first side wall, and a second side channel formed in at least a portion of the breaker strip that forms at least a portion of an upper periphery of the second side wall, and wherein each of the front channel, rear channel, first side channel, and second side channel is configured to permit attachment of the storage container thereto.

* * * * *